US012782027B2

(12) United States Patent
Peng

(10) Patent No.: US 12,782,027 B2
(45) Date of Patent: Nov. 3, 2026

(54) MOLD STRUCTURE FOR MAKING HIGH-TRANSPARENCY ICE

(71) Applicant: Shenzhen Kean Silicone Product Co., Ltd, Shenzhen (CN)

(72) Inventor: Pandian Peng, Shenzhen (CN)

(73) Assignee: Shenzhen Kean Silicone Product Co., Ltd, Shenzhen (CN)

( * ) Notice: Subject to any disclaimer, the term of this patent is extended or adjusted under 35 U.S.C. 154(b) by 102 days.

(21) Appl. No.: 19/019,569

(22) Filed: Jan. 14, 2025

(65) Prior Publication Data

US 2026/0139886 A1 May 21, 2026

(30) Foreign Application Priority Data

Nov. 20, 2024 (CN) ..... 202422825193.6
Dec. 11, 2024 (CN) ..... 202423056736.9

(51) Int. Cl.
*F25C 1/04* (2018.01)
*F25C 1/18* (2006.01)

(52) U.S. Cl.
CPC . *F25C 1/04* (2013.01); *F25C 1/18* (2013.01)

(58) Field of Classification Search
CPC ..... F25C 1/04; F25C 1/18; F25C 2500/06
See application file for complete search history.

(56) References Cited

FOREIGN PATENT DOCUMENTS

CN 220911745 U 5/2024

*Primary Examiner* — James Sanders

(57) ABSTRACT

The present application relates to the technical field of ice-making devices, and specifically refers to a mold structure for making high-transparency ice, which includes an ice tray mold and an ice bucket. The ice tray mold is provided with a plurality of cavities, and a bottom portion of the ice tray mold is provided with a plurality of first through-holes. The ice tray mold is provided with a plurality of first locking snaps. The ice tray mold is detachably provided in an upper end opening of the ice bucket through the first locking snaps, thereby stabilizing the plurality of cavities in the ice tray mold. The ice bucket is provided therein with a water storage chamber. The plurality of cavities are in communication with the water storage chamber through the corresponding plurality of first through-holes.

12 Claims, 5 Drawing Sheets

MOLD STRUCTURE FOR MAKING HIGH-TRANSPARENCY ICE

CROSS REFERENCE TO RELATED APPLICATIONS

The present application claims the benefit of Chinese Patent Application Nos. 202423056736.9 filed on Dec. 11, 2024 and 202422825193.6 filed on Nov. 20, 2024. All the above are hereby incorporated by reference in their entirety.

TECHNICAL FIELD

The present application relates to the technical field of ice-making devices, and specifically refers to a mold structure for making high-transparency ice.

BACKGROUND TECHNOLOGY

Refrigerators have become an indispensable appliance in household life. Besides storing food, refrigerators can also provide users with ice cubes for daily needs. Ice cubes in refrigerators are usually formed using ice trays. However, in the existing technology, ice cubes made using ice trays often have poor transparency. The main reason for the opacity is that water in the ice tray freezes from the outside to the inside. The air dissolved in the water is released and forms air bubbles that are trapped by the ice and cannot be discharged. These air bubble contents significantly reduce the transparency of the ice cubes.

Chinese Patent CN220911745U discloses a device for making high-transparency ice pieces, including an ice tray mold and an ice bucket. The ice tray mold is provided with a plurality of cavities for forming ice, and the ice bucket has an insulation structure. The ice tray mold includes a bottom mold, and a plurality of first grooves formed on the bottom mold. These first grooves form cavities. A plurality of first through-holes are formed on the bottom mold and communicate with the corresponding first grooves. When the bottom mold is put in the ice bucket, the cavities communicate with the inner cavity of the ice bucket below through the first through-holes. The ice tray mold also includes a mold cover, and the mold cover is provided with a plurality of second grooves and a plurality of second through-holes. The plurality of second through-holes communicate with the corresponding second grooves respectively. The mold cover matches with the bottom mold, so that the second grooves match with the corresponding first grooves to form the cavities.

Since there is a coefficient of expansion during the process of water freezing into ice, in the ice-making process, the existing technology mentioned above experiences displacement between the ice tray mold and the ice bucket, as well as between the bottom mold and the mold cover. This results in the formation of ice pieces that have incomplete shapes. Secondly, the direct contact between the water in the bottom mold and the ice bucket makes it difficult to remove the bottom mold and the ice, affecting the user experience. Therefore, the existing technology still needs improvement and development.

SUMMARY

A purpose of the present application is to address the defects and deficiencies of the existing technology, and provide a mold structure for making high-transparency ice with a reasonable structure and good molding effect.

In order to achieve the above purpose, the present application adopts the following technical scheme:

The present application discloses a mold structure for making high-transparency ice, including an ice tray mold and an ice bucket, wherein the ice tray mold is provided with a plurality of cavities, and a bottom portion of the ice tray mold is provided with a plurality of first through-holes; the ice tray mold is provided with a plurality of first locking snaps, the ice tray mold is detachably provided in an upper end opening of the ice bucket through the first locking snaps, thereby stabilizing the plurality of cavities in the ice tray mold; the ice bucket is provided therein with a water storage chamber, and the plurality of cavities are in communication with the water storage chamber through the corresponding plurality of first through-holes.

According to the above scheme, the ice tray mold includes a mold cover and a mold base, a bottom of the mold cover and a top of the mold base are matching to form the plurality of cavities therebetween, the plurality of first through-holes are provided at a bottom portion of the mold base; the first locking snaps are provided on two sides of the ice tray mold, the mold cover is cooperatively connected to the mold base through the first locking snaps.

According to the above scheme, the present application further includes a bottom tray, the bottom tray is cooperatively connected to the ice bucket, the mold cover is connected to the bottom tray or the ice bucket through the first locking snaps, so that the mold cover, the mold base and the bottom tray are provided in the upper end opening of the ice bucket as a whole; a bottom face of the mold base is fitted on the bottom tray, the bottom tray is provided with a plurality of water-permeable holes, the plurality of water-permeable holes are matching one-to-one with the plurality of first through-holes, an inner cavity of the ice bucket forms the water storage chamber, the plurality of cavities are in communication with the water storage chamber through the plurality of first through-holes and the plurality of water-permeable holes.

According to the above scheme, the plurality of first locking snaps include a plurality of plate snaps and a plurality of snap members, two of the plate snaps are hingedly provided on the ice bucket or the bottom tray, two of the snap members are symmetrically provided on the mold cover, and the plate snaps are connected to the corresponding snap members, thereby connecting the mold cover with the mold base.

According to the above scheme, an inner wall of the ice bucket is provided with a platform, the bottom tray is embedded in the upper end opening of the ice bucket and is abutted on the platform; an outer sidewall of the bottom tray is provided with a position-limiting ring, an inner sidewall of the ice bucket is provided with a plurality of protruded snaps, and the plurality of protruded snaps are snap-fitted onto the position-limiting ring so that the bottom tray and the ice bucket are detachably connected.

According to the above scheme, an edge of the mold cover is provided with a first reinforcing ring, two snap members are symmetrically provided on two sides of the first reinforcing ring; an edge of the mold base is provided with a second reinforcing ring, two extension edges are symmetrically provided on two sides of the second reinforcing ring; an edge of the bottom tray is provided with a third reinforcing ring, two plate snaps are symmetrically provided on two sides of the third reinforcing ring, a position-limiting ring is provided at a bottom portion of the third reinforcing ring; the first reinforcing ring, the second reinforcing ring, and the third reinforcing ring are nested in sequence to form an integrated structure.

According to the above scheme, the mold cover is provided with a plurality of upwardly protruding shells, the mold base is provided with a plurality of downwardly recessing shells, the shells on the mold cover and the shells on the mold base are matching one-to-one to form the plurality of cavities; the bottom tray is provided with a plurality of downwardly recessing fitting shells, the shells on the mold base and the fitting shells on the bottom tray are matching one-to-one, so that a bottom face of the mold base is fitted on the bottom tray, and the plurality of water-permeable holes are opened on the corresponding fitting shells respectively.

According to the above scheme, the present application further includes a plurality of supporting cylinders, upper ends of the plurality of supporting cylinders are fixedly connected to the corresponding fitting shells respectively, lower end openings of the supporting cylinders are provided therein with gradually retractable end plugs, inner cavities of the supporting cylinders between the fitting shells and the gradually retractable end plugs form a plurality of water storage chambers, and the plurality of cavities are in communication with the corresponding plurality of water storage chambers through the first through-holes and the water-permeable holes.

According to the above scheme, the gradually retractable end plugs are each provided with a plurality of supporting partitions, and upper ends of the plurality of supporting partitions are abutted against the fitting shells.

According to the above scheme, first sides of the plurality of supporting partitions on each gradually retractable end plug are connected to each other to form a star-shaped structure, and second sides of the plurality of supporting partitions abut against inner sidewalls of the supporting cylinders, thereby dividing each of the plurality of water storage chambers into a plurality of water-storing cavities.

According to the above scheme, a plurality of sealing rings are provided on outer edge faces of the gradually retractable end plugs, and stop rings are provided on bottom faces of the gradually retractable end plugs.

According to the above scheme, an inner sidewall of the second reinforcing ring is provided with a water level scale.

According to the above scheme, the mold cover is provided with a plurality of weak regions, the plurality of weak regions are matching one-to-one with the plurality of cavities, the mold cover is provided with a plurality of second through-holes, the plurality of second through-holes are matching one-to-one with the plurality of cavities.

According to the above scheme, a sidewall and a bottom portion of the ice bucket are provided with an insulation layer, and a plurality of cutouts are provided on the insulation layer at the upper end opening of the ice bucket.

The beneficial effects of the present application are that: the present application is reasonable in structure. The ice tray mold is disposed in the upper end opening of the ice bucket, and is locked through the first locking snaps. This avoids displacement of the ice tray mold during the ice-making process, resulting in deformation of the cavities. The formed ice pieces have a standard and uniform shape.

DETAILED EMBODIMENTS

The technical scheme of the present application is described below in conjunction with the accompanying drawings and embodiments.

Embodiment 1

Figure 1:
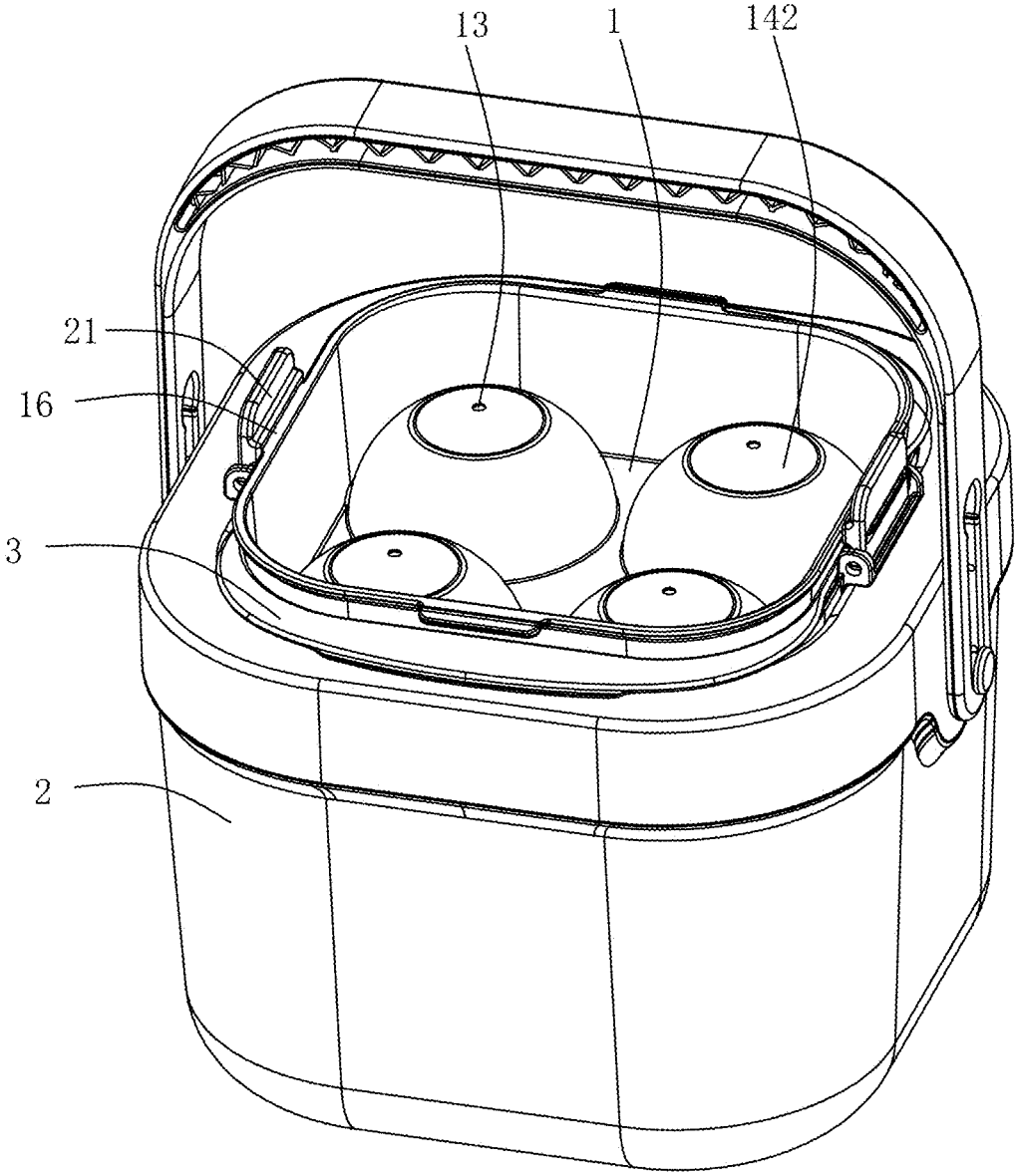
FIG. 1 is a schematic diagram of the overall structure of the present application.
Figure 2:
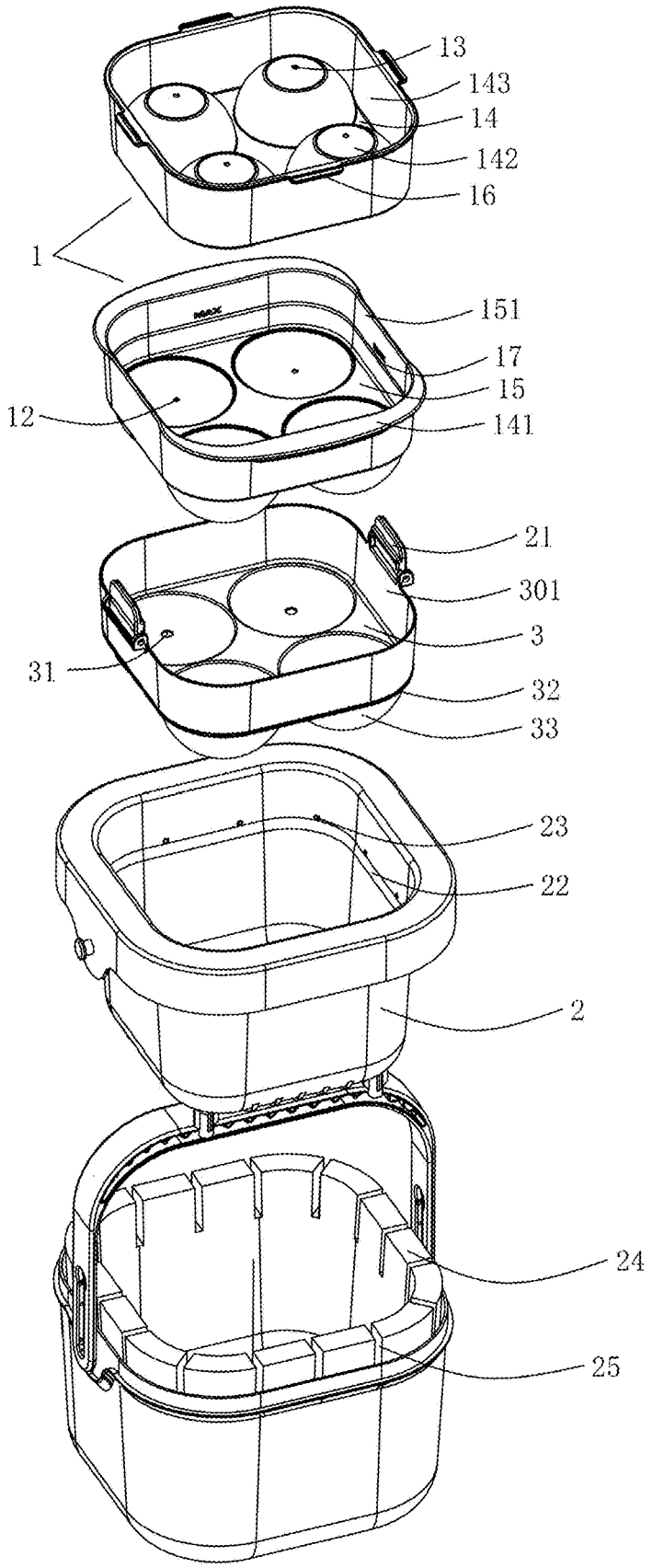
FIG. 2 is a schematic diagram of the exploded overall structure of Embodiment 1 of the present application.
Figure 3:
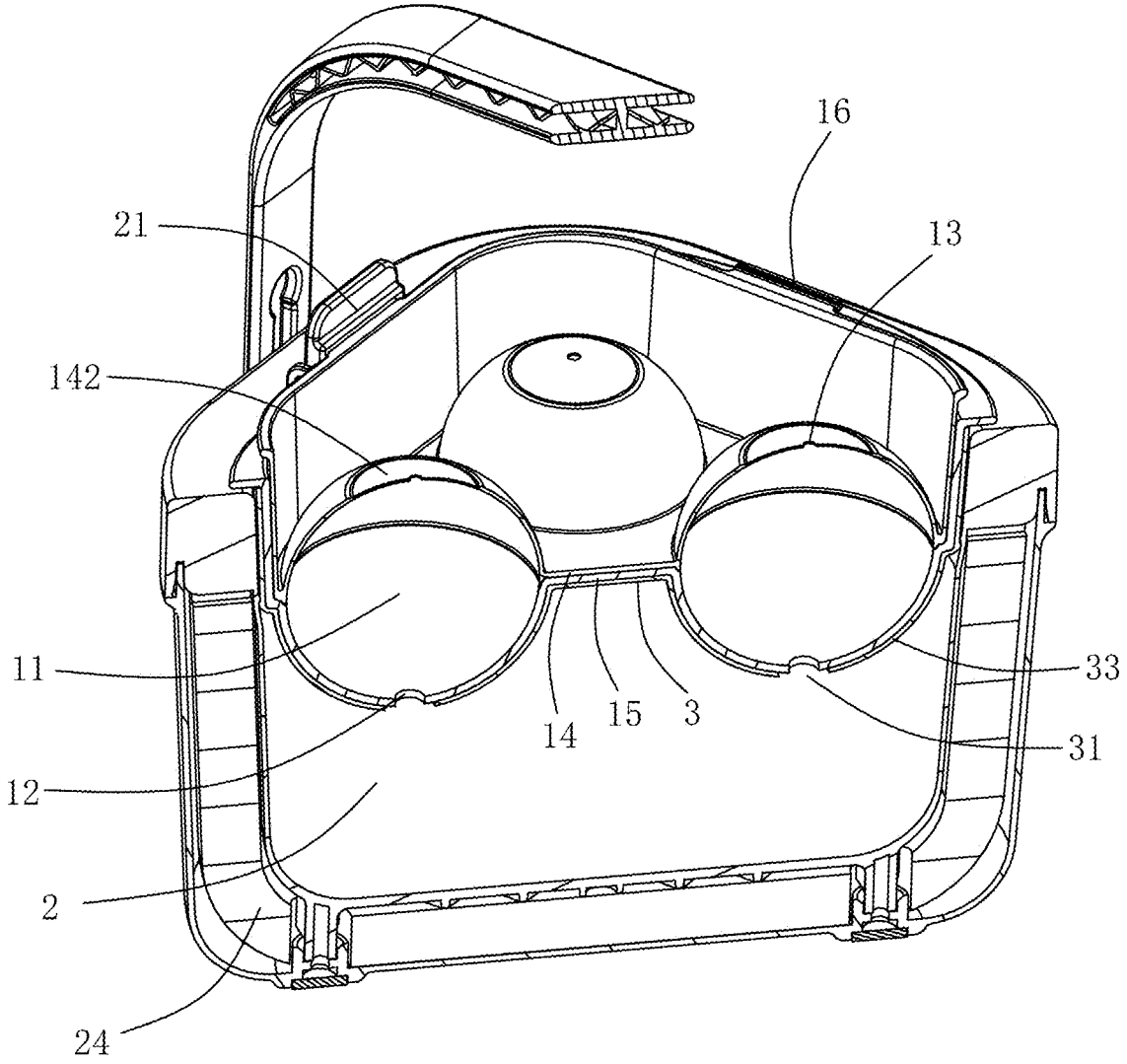
FIG. 3 is a schematic diagram of the cross-section of the structure of Embodiment 1 of the present application.

As shown in FIGS. 1-3, the present application discloses a mold structure for making high-transparency ice, which includes an ice tray mold 1 and an ice bucket 2. The ice tray mold 1 is provided with a plurality of cavities 11. A bottom portion of the ice tray mold 1 is provided with a plurality of first through-holes 12. The ice tray mold 1 is provided with a plurality of first locking snaps, and the ice tray mold 1 is detachably provided in an upper end opening of the ice bucket 2 through the first locking snaps, thereby stabilizing the plurality of cavities 11 in the ice tray mold 1. The ice bucket 2 is provided therein with a water storage chamber, and the plurality of cavities 11 are in communication with the water storage chamber through the corresponding plurality of first through-holes 12.

The ice tray mold 1 includes a plurality of cavities 11. The cavities 11 are used for forming ice and controlling the shape of the ice pieces. The ice tray mold 1 can be assembled and disassembled, so that the ice pieces in the cavities 11 can be taken out. The ice tray mold 1 can be locked and unlocked through the first locking snaps, thereby avoiding deformation of the cavities 11 in the ice-making process. The ice tray mold 1 is disposed in the upper end opening of the ice bucket 2, and the cavities 11 can communicate with the water storage chamber through the first through-holes 12. Of course, the ice tray mold 1 is also provided with a plurality of second through-holes 13, and the second through-holes 13 are formed at the top portion of the ice tray mold 1 and can communicate with the cavities 11 respectively. The cavities 11 can communicate with the outside through the second through-holes 13. The cavities 11 are used for making ice pieces of high transparency. The ice-making principle of the ice tray mold 1 is the same as the existing technology, and so it is not repeated herein.

The water storage chamber and the cavities 11 are filled up with water, and the volume of water increases during freezing, and the phenomenon of expansion occurs. In the ice-making process, the first locking snaps can relatively lock the ice tray mold 1, so that the ice pieces will not be displaced, leading to deformation of the ice tray mold 1. This makes sure that the shape of the ice pieces is standard and uniform.

Since the ice-making process is from top to bottom (first, the ice tray mold 1, and then the water storage chamber), and at the same time the ice-making process in the cavities 11 is also from top to bottom. When the water in the cavities 11 gradually forms into ice, some water and air bubbles will be discharged into the water storage chamber through the first through-holes 12, so that the production of air bubbles and empty cavities in the ice pieces can be avoided and high-transparency ice pieces can be obtained.

Specifically, the ice tray mold 1 includes a mold cover 14 and a mold base 15. The bottom of the mold cover 14 and the top of the mold base 15 are matching to form therebetween the plurality of cavities 11. The plurality of first through-holes 12 are provided at a bottom portion of the mold base 15. The first locking snaps are provided on two sides of the ice tray mold 1, and the mold cover 14 is cooperatively connected to the mold base 15 through these first locking snaps. Two sets of the first locking snaps can be symmetrically arranged on two sides of the ice tray mold 1, so that the mold cover 14 and the mold base 15 are connected and locked to prevent the cavities 11 from being deformed.

The present application further includes a bottom tray 3, and the bottom tray 3 is cooperatively connected to the ice bucket 2. The mold cover 14 is connected to the bottom tray 3 or the ice bucket 2 through the first locking snaps, so that the mold cover 14, the mold base 15, and the bottom tray 3 are provided in the upper end opening of the ice bucket 2 as a whole. The bottom face of the mold base 15 is fitted on the bottom tray 3. The bottom tray 3 is provided with a plurality of water-permeable holes 31, and the plurality of water-permeable holes 31 are matching one-to-one with the plurality of first through-holes 12. Of course, the diameter of the water-permeable holes 31 is usually greater than the diameter of the first through-holes 12. An inner cavity of the ice bucket 2 forms the water storage chamber. The plurality of cavities 11 are in communication with the water storage chamber through the plurality of first through-holes 12 and the plurality of water-permeable holes 31.

Water can flow into the water storage chamber. The inner cavity of the ice bucket 2 can be directly used as a water storage chamber, i.e., water is in the ice bucket 2. First of all, the bottom tray 3 is put in the ice bucket 2, and the water in the water storage chamber can overflow above the bottom tray 3 through the water-permeable holes 31, so that the bottom tray 3 is immersed below the water level in the water storage chamber. The mold base 15 is then put into the ice bucket 2, and the bottom face of the mold base 15 is fitted on the bottom tray 3 so that its position can be restricted. Finally, the mold cover 14 is snap-fitted to form the ice tray mold 1. The plate snaps 21 are snapped onto the snap members 16 so that the ice tray mold 1 is locked.

It is understandable that when the bottom tray 3, the mold base 15 and the mold cover 14 are successively installed in the ice bucket 2, the water in the ice bucket 2 flows into the cavities 11 through the water-permeable holes 31 and the first through-holes 12 successively. Preferably, the bottom tray 3 is provided with a water level scale 17, so that the cavities can be fully filled with water after the mold cover 14 is installed.

As mentioned above, the ice-making process in the cavities 11 is also from top to bottom. When the water in the cavities 11 gradually forms into ice, some water and air bubbles will be discharged into the water storage chamber through the first through-holes 12, so that the production of air bubbles and empty cavities in the ice pieces can be avoided and high-transparency ice pieces can be obtained. Further, the bottom tray 3 is used for separating the ice tray mold 1 from the inner cavity of the ice bucket 2. When the water in the cavities 11 has become ice, the water in the ice bucket 2 will also gradually freeze. Due to the existence of the bottom tray 3, the contact surface of the mold base 15 and the ice pieces the ice bucket 2 is very small, so that the ice tray mold 1 can be taken out more conveniently. This facilitates demolding of the mold cover 14 and the mold base 15 as well as taking out the ice pieces in the cavities 11.

Specifically, the plurality of first locking snaps include a plurality of plate snaps 21 and a plurality of snap members 16. Two of the plate snaps 21 are hingedly provided on the ice bucket 2 or the bottom tray 3, and two of the snap members 16 are symmetrically provided on the mold cover 14. The plate snaps 21 are connected to the corresponding snap members 16, thereby connecting the mold cover 14 to the mold base 15.

The plate snaps 21 can be provided on the ice bucket 2. The plate snaps 21 are snap-fitted onto and connected with the snap members 16. The mold cover 14 and the ice bucket 2 are snap-fitted together, and the mold base 15 is clamped. Alternatively, the plate snaps 21 are provided on the mold base 15. The plate snaps 21 are snapped onto the snap members 16, so that the mold cover 14 and the mold base 15 are connected as a whole to form the ice tray mold 1. The ice tray mold 1 is put into the ice bucket 2 and is connected with the ice bucket 2 through the mold base 15.

Further, through actual mold opening tests, it can be seen that the material of the ice tray mold 1 can be silicone, so that the shape of the ice pieces is better. Preferably, the bottom tray 3 uses a plastic material so that it has a better strength. The bottom tray 3 does not float in the ice bucket 2 because it is restricted by second locking snaps. At the same time, there is a gap between the bottom tray 3 and the inner wall of the ice bucket 2. The water in the gap can make the bottom tray 3 adhere to the ice bucket 2 after freezing of the water. This prevents the water in the ice bucket 2 from pushing the bottom tray 3 and the ice tray mold 1 when the water freezes and expands, and avoids the empty cavity phenomenon of the ice pieces in the cavities 11.

Further, when the water in the cavities 11 becomes ice, continuous freezing can cause the water in the ice bucket 2 to freeze and expand. At this moment, the ice in the ice bucket 2 will push the bottom tray 3 and the ice tray mold 1 to float together. However, the ice pieces in the cavities 11 and the ice pieces in the ice bucket 2 are only connected by ice pillars having the size of the diameter of the first through-holes 12, which are easy to be broken when demolding, so that the ice pieces can be demolded.

An inner wall of the ice bucket 2 is provided with a platform 22. The bottom tray 3 is embedded in the upper end opening of the ice bucket 2 and abutted on the platform 22. An outer sidewall of the bottom tray 3 is provided with a position-limiting ring 32. An inner sidewall of the ice bucket 2 is provided with a plurality of protruded snaps 23. The plurality of protruded snaps 23 are snap-fitted to the position-limiting ring 32 so that the bottom tray 3 and the ice bucket 2 are detachably connected. The platform 22 is used to limit the depth of installation of the bottom tray 3 in the ice bucket 2, and cooperate with the water level scale 17 to control the amount of water pours into the ice bucket 2. Further, the plurality of protruded snaps 23 are snap-fitted and connected to the position-limiting ring 32 so that the bottom tray 3 can be prevented from floating.

An edge of the mold cover 14 is provided with a first reinforcing ring 143, and two snap members 16 can be symmetrically provided on two sides of the first reinforcing ring 143. An edge of the mold base 15 is provided with a second reinforcing ring 151, and two extension edges 141 can be symmetrically provided on two sides of the second reinforcing ring 151. An edge of the bottom tray 3 is provided with a third reinforcing ring 301, and two plate snaps 21 can be symmetrically provided on two sides of the third reinforcing ring 301. The position-limiting ring 32 is provided at a bottom portion of the third reinforcing ring 301. The first reinforcing ring 143, the second reinforcing ring 151, and the third reinforcing ring 301 are nested in sequence to form an integrated structure. The bottom tray 3 and the ice tray mold 1 are embedded and provided in the upper end opening of the ice bucket 2, so that the water in the ice bucket 2 can fill up the cavities 11. The bottom portion of the bottom tray 3 is limited by the position-limiting ring 32 and the platform 22. However, the ice tray mold 1 and the first locking snaps need to match with the upper end opening of the ice bucket 2. Through a nesting structure formed by the first reinforcing ring 143, the second reinforcing ring 151 and the third reinforcing ring 301, the ice tray mold 1 can be embedded and disposed in the upper end opening of the ice bucket 2.

It is understood that an inner sidewall of the second reinforcing ring 151 may be provided with a water level scale 17. Before making ice, the bottom tray 3 is first put into the ice bucket 2. Water is filled up to the water level scale 17 in the ice bucket 2. Then, the ice tray mold 1 is put into the bottom tray 3 and locked by the first locking snaps, so that the cavities 11 is just fully filled with water. This facilitates ice-making operation by the user.

Further, the first reinforcing ring 143, the second reinforcing ring 151 and the third reinforcing ring 301 all have a tubular structure, thereby enhancing the structural strength of the mold cover 14, the mold base 15 and the bottom tray 3. Two sidewalls of the second reinforcing ring 151 are provided with two extension edges 141. Pulling the two extension edges 141 apart can deform the second reinforcing ring 151 as well as the mold base 15, so that the ice pieces in the cavities 11 can be easily demolded from the mold base 15.

The mold cover 14 is provided with a plurality of upwardly protruding shells, and the mold base 15 is provided with a plurality of downwardly recessing shells. The shells on the mold cover 14 and the shells on the mold base 15 are matching one-to-one to form the plurality of cavities 11. The bottom tray 3 is provided with a plurality of downwardly recessing fitting shells 33. The shells on the mold base 15 and the fitting shells 33 on the bottom tray 3 are matching one-to-one, so that a bottom face of the mold base 15 is fitted on the bottom tray 3. The plurality of water-permeable holes 31 are opened on the corresponding fitting shells 33 respectively.

The present application is usually used for making spherical ice pieces. The shells and the fitting shells 33 are hemispherical structures. The mold base 15 is fitted on the bottom tray 3 to reduce the contact area of the ice pieces in the ice tray mold 1 and the ice pieces in the ice bucket 2, so that the ice tray mold 1 can be easily removed from the ice bucket 2 and then demolded.

The mold cover 14 is provided with a plurality of weak regions 142, and the plurality of weak regions 142 are matching one-to-one with the plurality of cavities 11. The mold cover 14 is provided with a plurality of second through-holes 13, and the plurality of second through-holes 13 are matching one-to-one with the plurality of cavities 11. The thickness of the weak regions 144 is less than the overall thickness of the mold cover 14. The ice pieces can be more easily demolded from the mold cover 14 by pressing the weak regions 144.

A sidewall and a bottom portion of the ice bucket 2 are provided with an insulation layer 24, and a plurality of cutouts 25 are provided on the insulation layer 24 at the upper end opening of the ice bucket 2. As mentioned above, when the present application is making ice, the ice-making process is progressing from top to bottom. The sidewall and the bottom portion of the ice bucket 2 are covered by the insulation layer 24, so that the ice tray mold 1 in the upper end opening of the ice bucket 2 is directly in contact with cold air. The freezing of the water in the cavities 11 takes place first before freezing of the water in the inner cavity of the ice bucket 2.

Further, the cutouts 25 can reduce the insulation effect of the insulation layer 24. The ice tray mold 1 provided in the upper end opening of the ice bucket 2 is more likely to freeze, and the ice-making efficiency is improved.

Embodiment 2

Figure 4:
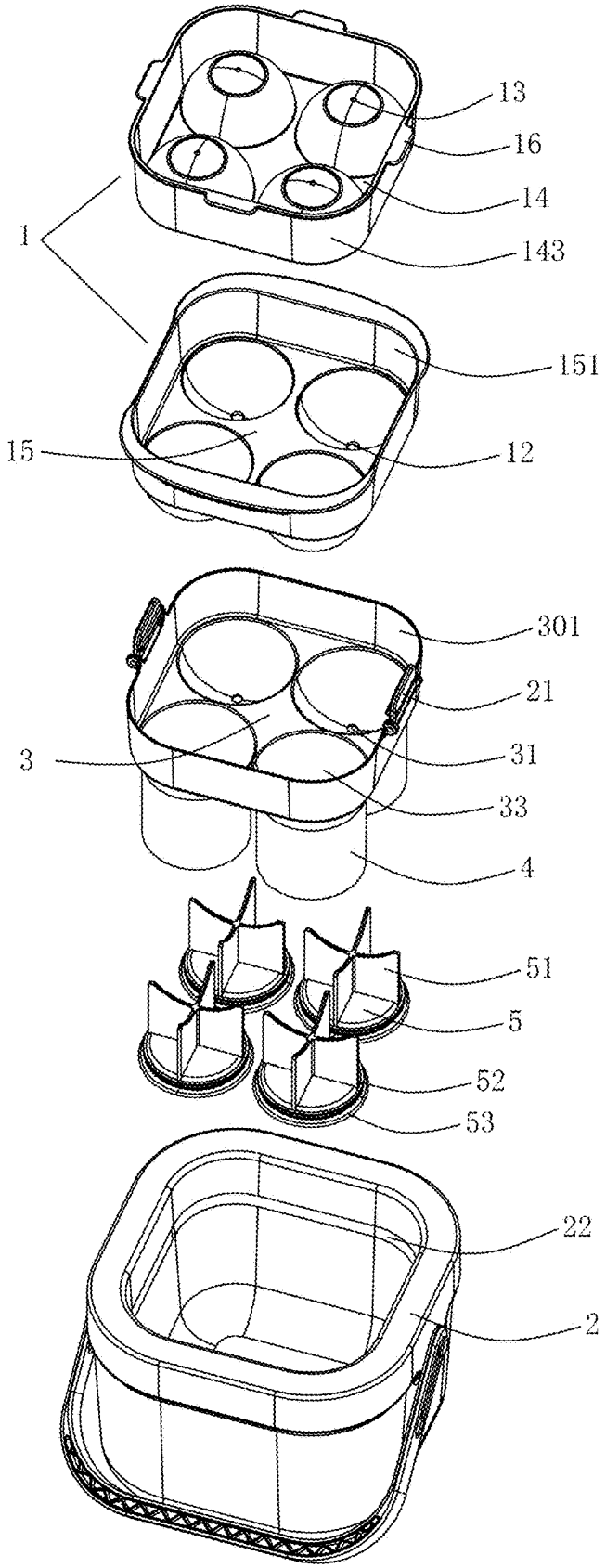
FIG. 4 is a schematic diagram of the exploded overall structure of Embodiment 2 of the present application.
Figure 5:
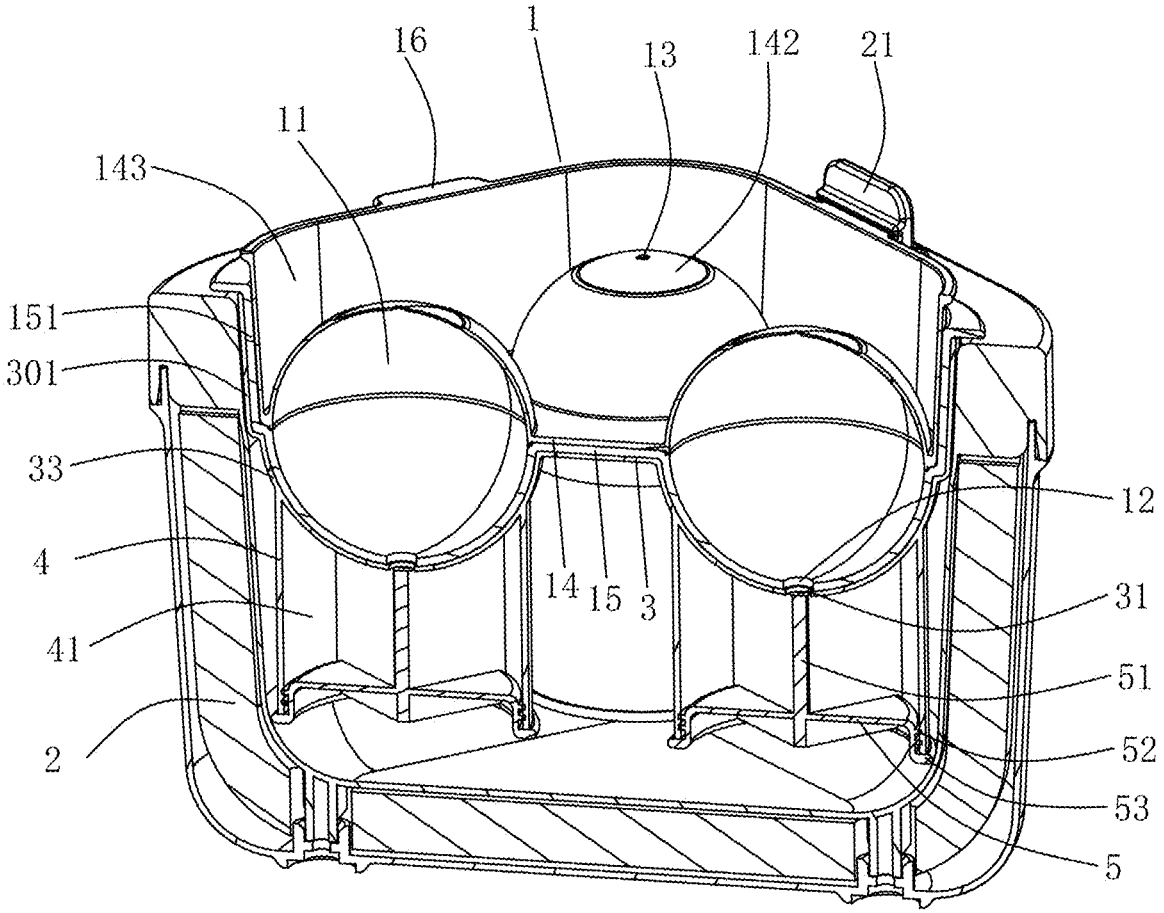
FIG. 5 is a schematic diagram of the cross-section of the structure of Embodiment 2 of the present application In the figures: 1, ice tray mold; 2, ice bucket; 3, bottom tray; 4, supporting cylinder; 5, gradually retractable end plug; 11, cavity; 12, first through-hole; 13, second through-hole; 14, mold cover; 15, mold base; 16, snap member; 17, water level scale; 21, plate snap; 22, platform; 23, protruded snap; 24, insulation layer; 25, cutout; 31, water-permeable hole; 32, position-limiting ring; 33, fitting shell; 41, water-storing cavity; 51, supporting partition; 52, sealing ring; 53, stop ring; 141, extension edge; 142, weak region; 143, first reinforcing ring; 151, second reinforcing ring; 301, third reinforcing ring.

As shown in FIGS. 4-5, the present embodiment is distinguished from Embodiment 1 only in that the present application further includes a plurality of supporting cylinders 4. The upper ends of the plurality of supporting cylinders 4 are fixedly connected to the corresponding fitting shells 33 respectively, and the lower end openings of the supporting cylinders 4 are provided therein with gradually retractable end plugs 5. Inner cavities of the supporting cylinders 4 between the fitting shells 33 and the gradually retractable end plugs 5 form a plurality of water storage chambers. The plurality of cavities 11 are in communication with the corresponding plurality of water storage chambers through the first through-holes 12 and the water-permeable holes 31.

When making ice, the cavities 11 and the inner cavities in the supporting cylinders 4 are filled with water. The water in the cavities 11 freezes first. The expansion pressure generated by freezing causes excess water to be discharged into the supporting cylinders 4 through the first through-holes 12.

Thereafter, the water in the supporting cylinders 4 also begins to form into ice, and this ice-forming process also occurs from top to bottom. At this moment, the pressure in the supporting cylinders 4 further increases. Preferably, the fitting between the gradually retractable end plugs 5 and the supporting cylinders 4 are interference fit. Under the action of internal pressure, the gradually retractable end plugs 5 slide downward along the inner walls of the supporting cylinders 4. The expansion problem caused by the pressure can be eliminated by changing the inner cavity volume of the supporting cylinders 4, and the overall structure of the supporting cylinders 4 is prevented from deformation.

It is understandable that the supporting cylinders 4 need to be stably arranged in the ice bucket 2, so that the upper ends of the supporting cylinders 4 are in contact with the bottom surface of the ice tray mold 1. This ensures the sealing effect of the connecting portions between the supporting cylinders 4 and the ice tray mold 1. Therefore, the supporting cylinders 4 can be connected to the upper end opening of the ice bucket 2, or the lower ends of the supporting cylinders 4 can be connected to the bottom portion of the ice bucket 2, or the supporting cylinders 4 is limited and supported in the ice bucket 2 through other supporting structures. In this embodiment, it is preferable that the supporting cylinders 4 are directly connected with the fitting shells 33 as a whole, so that the supporting cylinders 4 are fixedly provided in the ice bucket 2 through the bottom tray 3.

The whole bottom tray 3 is in the shape of a basin, so that the ice tray mold 1 can be assembled with the bottom tray 3. In particular, the bottom tray 3 is provided with a plurality of fitting shells 33. The fitting shells 33 are recessing downwardly so as to satisfy the space required by the cavities 11. Hence, the bottom tray 3 can fit and in contact with the profile of the bottom surface of the ice tray mold 1. Preferably, the supporting cylinders 4 are integrally connected with the fitting shells 33, and the fitting shells 33 are fitted to the bottom face of the ice tray mold 1. After the water in the cavities 11 and the supporting cylinders 4 forms into ice, the ice tray mold 1 can be directly separated from the bottom tray 3, so as to facilitate demolding of the high-transparency ice pieces formed in the cavities 11. At the same time, the gradually retractable end plugs 5 are taken out from the lower openings of the supporting cylinders 4, and the ice pieces in the supporting cylinders 4 can be demolded.

In the process of actual use, the formation of high-transparency ice pieces in the cavities 11 of the ice tray mold 1 is the main purpose. The critical time point at which the water in the cavity 11 freezes and the water in supporting cylinders 4 does not freeze is uncontrollable or cannot be waited for by the user. Thus, when the present application is making ice for one time, it usually obtains high-transparency ice pieces in the cavities 11, and it also obtains ordinary ice pieces in the supporting cylinders 4. Since the cavities 11 and the supporting cylinders 4 communicate only through the first through-holes 12 and the water-permeable holes 31, the ice pieces between the two parts can easily be broken, so that the utilization rate of water and the quantity of ice pieces prepared can be improved.

The gradually retractable end plugs 5 are each provided with a plurality of supporting partitions 51, and the upper ends of the plurality of supporting partitions 51 are abutted against the fitting shells 33. The plurality of supporting partitions 51 can first improve the structural stability of the fitting shells 33 and prevent water from causing deformation of the fitting shell 33 when the water becomes ice. Further, the first sides of the plurality of supporting partitions 51 of each gradually retractable end plug 5 are connected to each other to form a star-shaped structure. The second sides of the plurality of supporting partitions 51 abut against the inner sidewalls of the supporting cylinders 4, thereby dividing each of the plurality of water storage chambers into a plurality of water-storing cavities 41. The supporting partitions 51 can divide the water storage chamber, so that a plurality of ice pieces in the plurality of water-storing cavities 41 are obtained, and the quantity of ice production is increased.

A plurality of sealing rings 52 are provided on the outer edge faces of the gradually retractable end plugs 5, and stop rings 53 are provided on the bottom faces of the gradually retractable end plugs 5. The gradually retractable end plugs 5 are embedded in the lower end openings of the supporting cylinders 4, and the gradually retractable end plugs 5 can slide up and down along the inner walls of the supporting cylinders 4. The plurality of sealing rings 52 are used for ensuring tightness at the bottom of the supporting cylinders 4. Further, when the water in the supporting cylinders 4 begins to freeze and expand, the gradually retractable end plugs 5 can slide along the inner walls of the supporting cylinders 4 to expand the inner cavity volume of the supporting cylinders 4, and prevent the pressure from expanding upwards to affect the stability of the ice tray mold 1. It is understandable that the outer diameter of the stop rings 53 is greater than the diameter of the supporting cylinders 4. The stop rings 53 are used for matching with the lower end openings of the supporting cylinders 4, so that the position of the gradually retractable end plugs 5 and the supporting cylinders 4 can be limited. This facilitates the removal of the gradually retractable end plugs 5.

The foregoing is merely the preferred embodiments of the present application. Any equivalent variations or modifications made in accordance with the structures, features and principle in the scope of the present application patent application are included in the scope of the present application patent application.

What is claimed is:

1. A mold structure for making high-transparency ice, comprising an ice tray mold (1) and an ice bucket (2), wherein the ice tray mold (1) is provided with a plurality of cavities (11), and a bottom portion of the ice tray mold (1) is provided with a plurality of first through-holes (12); characterized in that: the ice tray mold (1) is provided with a plurality of first locking snaps, the ice tray mold (1) is detachably provided in an upper end opening of the ice bucket (2) through the plurality of first locking snaps, thereby stabilizing the plurality of cavities (11) in the ice tray mold (1); the ice bucket (2) is provided therein with a water storage chamber, and the plurality of cavities (11) are in communication with the water storage chamber through the corresponding plurality of first through-holes (12); and characterized in that: the ice tray mold (1) comprises a mold cover (14) and a mold base (15), a bottom of the mold cover (14) and a top of the mold base (15) are matching to form therebetween the plurality of cavities (11), the plurality of first through-holes (12) are provided at a bottom portion of the mold base (15); the plurality of first locking snaps are provided on two sides of the ice tray mold (1), and the mold cover (14) is cooperatively connected to the mold base (15) through the plurality of first locking snaps; a bottom tray (3), the bottom tray (3) is cooperatively connected to the ice bucket (2), the mold cover (14) is connected to the bottom tray (3) or the ice bucket (2) through the plurality of first locking snaps, so that the mold cover (14), the mold base (15), and the bottom tray (3) are provided in the upper end opening of the ice bucket (2) as a whole; a bottom face of the mold base (15) is fitted on the bottom tray (3), the bottom tray (3) is provided with a plurality of water-permeable holes (31), the plurality of water-permeable holes (31) are matching one-to-one with the plurality of first through-holes (12), an inner cavity of the ice bucket (2) forms the water storage chamber, and the plurality of cavities (11) are in communication with the water storage chamber through the plurality of first through-holes (12) and the plurality of water-permeable holes (31).

2. The mold structure for making high-transparency ice as claimed in claim 1, characterized in that: the plurality of first locking snaps comprise a plurality of plate snaps (21) and a plurality of snap members (16), two of the plate snaps (21) are hingedly provided on the ice bucket (2) or the bottom tray (3), two of the snap members (16) are symmetrically provided on the mold cover (14), and the plurality of plate snaps (21) are connected to the corresponding plurality of snap members (16), thereby connecting the mold cover (14) with the mold base (15).

3. The mold structure for making high-transparency ice as claimed in claim 1, characterized in that: an inner wall of the ice bucket (2) is provided with a platform (22), the bottom tray (3) is embedded in the upper end opening of the ice bucket (2) and abutted on the platform (22); an outer sidewall of the bottom tray (3) is provided with a position-limiting ring (32), an inner sidewall of the ice bucket (2) is provided with a plurality of protruded snaps (23), and the plurality of protruded snaps (23) are snap-fitted onto the position-limiting ring (32) so that the bottom tray (3) and the ice bucket (2) are detachably connected.

4. The mold structure for making high-transparency ice as claimed in claim 1, characterized in that: an edge of the mold cover (14) is provided with a first reinforcing ring (143), two snap members (16) are symmetrically provided on two sides of the first reinforcing ring (143); an edge of the mold base (15) is provided with a second reinforcing ring (151), two extension edges (141) are symmetrically provided on two sides of the second reinforcing ring (151); an edge of the bottom tray (3) is provided with a third reinforcing ring (301), two plate snaps (21) are symmetrically provided on two sides of the third reinforcing ring (301), a position-limiting ring (32) is provided at a bottom portion of the third reinforcing ring (301); the first reinforcing ring (143), the second reinforcing ring (151), and the third reinforcing ring (301) are nested in sequence to form an integrated structure.

5. The mold structure for making high-transparency ice as claimed in claim 1, characterized in that: the mold cover (14) is provided with a plurality of upwardly protruding shells, the mold base (15) is provided with a plurality of downwardly recessing shells, the shells on the mold cover (14) and the shells on the mold base (15) are matching one-to-one to form the plurality of cavities (11); the bottom tray (3) is provided with a plurality of downwardly recessing fitting shells (33), the shells on the mold base (15) and the fitting shells (33) on the bottom tray (3) are matching one-to-one, so that a bottom face of the mold base (15) is fitted on the bottom tray (3), and the plurality of water-permeable holes (31) are opened on the corresponding fitting shells (33) respectively.

6. The mold structure for making high-transparency ice as claimed in claim 5, characterized in that it further comprises a plurality of supporting cylinders (4), upper ends of the plurality of supporting cylinders (4) are fixedly connected to the corresponding fitting shells (33) respectively, lower end openings of the supporting cylinders (4) are provided therein with gradually retractable end plugs (5) respectively, inner cavities of the supporting cylinders (4) between the fitting shells (33) and the gradually retractable end plugs (5) form a plurality of water storage chambers, and the plurality of cavities (11) are in communication with the corresponding plurality of water storage chambers through the first through-holes (12) and the water-permeable holes (31).

7. The mold structure for making high-transparency ice as claimed in claim 6, characterized in that the gradually retractable end plugs (5) are each provided with a plurality of supporting partitions (51), and upper ends of the plurality of supporting partitions (51) are abutted against the fitting shells (33).

8. The mold structure for making high-transparency ice as claimed in claim 7, characterized in that: first sides of the plurality of supporting partitions (51) on each gradually retractable end plug (5) are connected to each other to form a star-shaped structure, and second sides of the plurality of supporting partitions (51) abut against inner sidewalls of the supporting cylinders (4), thereby dividing each of the plurality of water storage chambers into a plurality of water-storing cavities (41).

9. The mold structure for making high-transparency ice as claimed in claim 6, characterized in that: a plurality of sealing rings (52) are provided on outer edge faces of the gradually retractable end plugs (5), and stop rings (53) are provided on bottom faces of the gradually retractable end plugs (5).

10. The mold structure for making high-transparency ice as claimed in claim 4, characterized in that: an inner sidewall of the second reinforcing ring (151) is provided with a water level scale (17).

11. The mold structure for making high-transparency ice as claimed in claim 1, characterized in that: the mold cover (14) is provided with a plurality of weak regions (142), the plurality of weak regions (142) are matching one-to-one with the plurality of cavities (11), the mold cover (14) is provided with a plurality of second through-holes (13), and the plurality of second through-holes (13) are matching one-to-one with the plurality of cavities (11).

12. The mold structure for making high-transparency ice as claimed in claim 1, characterized in that: a sidewall and a bottom portion of the ice bucket (2) are provided with an insulation layer (24), and a plurality of cutouts (25) are provided on the insulation layer (24) at the upper end opening of the ice bucket (2).

* * * * *